United States Patent [19]

Takeda et al.

[11] Patent Number: 4,879,563

[45] Date of Patent: Nov. 7, 1989

[54] CIRCULARLY POLARIZED COMPLEMENTARY ANTENNA WITH PATCH AND DIPOLE ELEMENTS

[75] Inventors: Shigeki Takeda; Akihiro Takahashi, both of Tokyo, Japan

[73] Assignee: Kyocera Corporation, Kyoto, Japan

[21] Appl. No.: 262,607

[22] Filed: Oct. 26, 1988

[30] Foreign Application Priority Data

Oct. 30, 1987 [JP] Japan ..... 62-275071
Oct. 30, 1987 [JP] Japan ..... 62-275072

[51] Int. Cl.[4] ..... H01Q 21/00

[52] U.S. Cl. ..... 343/725; 343/700 MS; 343/727

[58] Field of Search ..... 343/700 MS File, 725, 343/727, 728, 729, 747, 793, 794, 799, 804

[56] References Cited

U.S. PATENT DOCUMENTS 3,283,330 11/1966 Chatelain ..... 343/700 MS
4,035,807 7/1977 Tang et al. ..... 343/700 MS
4,502,053 2/1985 Dupressoir et al. ..... 343/727

*Primary Examiner*—Rolf Hille
*Assistant Examiner*—Doris J. Johnson
*Attorney, Agent, or Firm*—Spensley Horn Jubas & Lubitz

[57] ABSTRACT

An antenna includes a half-wave dipole antenna and a semicircular patch antenna to form a complementary antenna assembly. The respective antennas are supplied with power to 90° phase difference to generate a circular polarized wave.

4 Claims, 6 Drawing Sheets

FIG. 3
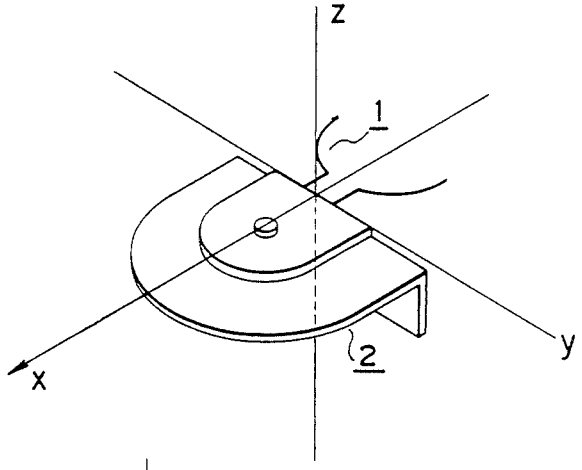
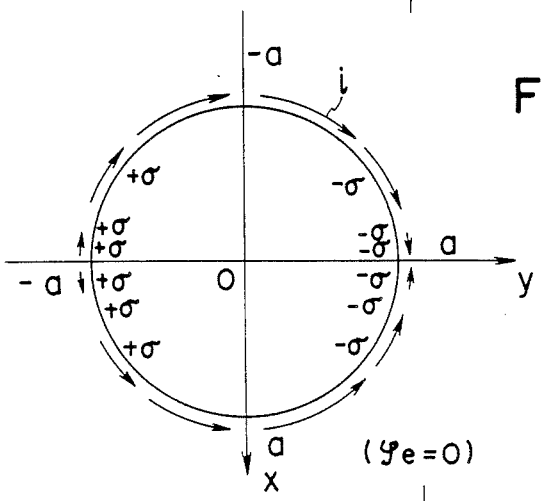
FIG. 4A
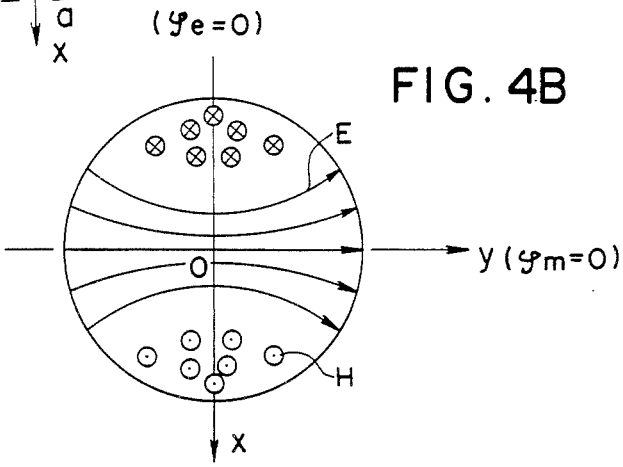
FIG. 4B

CIRCULARLY POLARIZED COMPLEMENTARY ANTENNA WITH PATCH AND DIPOLE ELEMENTS

FIELD OF THE INVENTION

This invention relates to a complementary antenna, and more particularly to an isotropic, improved complementary antenna having a circular polarization characteristic.

BACKGROUND OF THE INVENTION

GPS (global positioning system) antennas or other antennas for communication of a moving body such as an artificial satellite must have a property of clockwise circular polarization. Although there are various possible methods for obtaining such an antenna, it is very difficult to establish both a hemispherical or isotropic directivity and a circular polarization characteristic. In this situation, a conventional practical solution was array-arrangement of dipole, loop or other planar radiating elements, or alternatively the use of spiral tridimensional radiating elements.

These prior art antenna arrangements certainly enabled realization of an antenna substantially satisfying to a certain degree the aforementioned characteristics. However, it requires much experience and know-how. Besides this, the prior art antennas involve a certain compromise between the aforementioned characteristics, and various disadvantages, i.e. large scale and complicated structure of the entire antenna, difficult handling and cost increase.

OBJECT OF THE INVENTION

It is therefore an object of the invention to provide a quasi-planar antenna which is small-scaled, readily handled, simple-structured and provided with the aforementioned characteristic.

SUMMARY OF THE INVENTION

In order to obtain the object, the invention is characterized in that a half-wavelength dipole antenna bent into the form of a semicircle is disposed relatively adjacent, as compared to the specified wavelength, to a patch antenna in the form of a semicircle open at its circumferential portion and short-circuited at its straight portion, so that they form a pair of complementary antennas which are fed with phase 90° apart to realize a circular polarization characteristic.

Since the inventive half-wavelength dipole antenna and patch antenna have a complementary relationship, when the respective antennas are fed with phase difference of 90°, the former antenna acts as a substantially quasi-isotropic electric current source, whereas the latter antenna acts as a magnetic current source which is fed with phase difference of 90° from the former antenna. Since the sum of radiated electric fields from both antennas composes a circular polarization characteristic, a complementary antenna having the aforementioned characteristic is obtained.

BRIEF DESCRIPTION OF THE DRAWINGS

FIGS. 1 through 3 show an embodiment of the invention;

FIG. 4A is a diagram showing current and charge distribution on a full-wavelength loop antenna;

FIG. 4B is a diagram showing a corresponding electric field and magnetic field of the loop of FIG. 4A;

DETAILED DESCRIPTION

Figure 1:
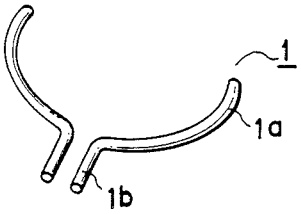

The invention is explained below, referring to preferred embodiments illustrated in the drawings.

A half-wavelength loop antenna 1 shown in FIG. 1 is made by bending a cord-shaped antenna element 1*a* into the form of a semicircular ring, and reference numeral 1*b* denotes a feeding point to be connected to a coaxial cable, etc.

Figure 2A:
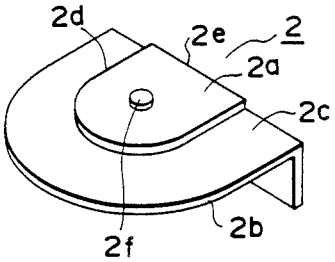
Figure 2B:
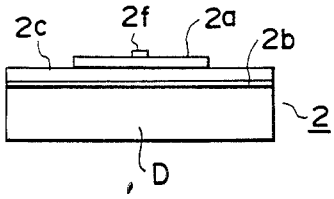
Figure 2C:
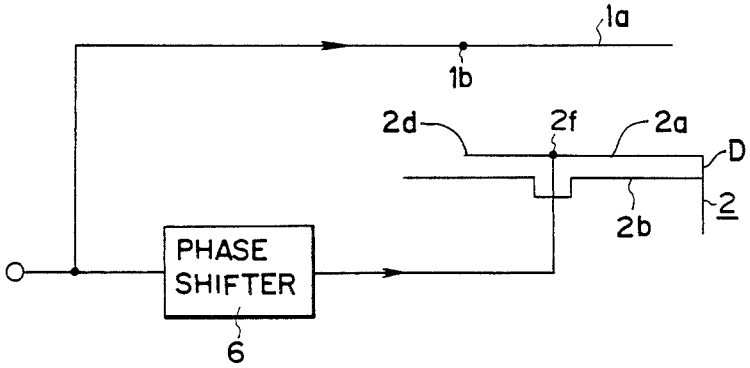

In contrast, a patch antenna 2 shown in FIG. 2A consists of an upper conduction plane 2*a* on a Teflon (trademark) plate 2 or the like and a ground plane member 2*b*. The upper conduction plane 2*a* is a semicircular conduction plane and acts as a radiation element. The circumferential portion 2*d* of the upper conduction plane 2*a* is open and its straight portion 2*e* is short-circuited to the ground plane member 2*b*. To a feeding point 2*f* is connected a coaxial cable, etc. Both antennas are disposed in confrontation through a small distance as compared to the wavelength, as shown in FIG. 3. The respective antennas are fed with phase 90° apart, using a phase shifter 6 as shown in FIG. 2C.

The above mentioned antenna assembly exhibits a desired circular polarization characteristic as explained below.

Since the sum of radiated electric fields from an electric current source and from a complementary magnetic current source with phase 90° apart composes a circular polarization characteristic, the use of this nature makes it possible to establish an antenna having a circular polarization characteristic.

The first step for obtaining such an antenna is to determine the configuration of a loop antenna (or dipole antenna) so that the absolute value of the radiation pattern disregarding the polarization characteristic coincides with the absolute value of a radiation pattern having a desired radiation characteristic.

The next step is to form a patch antenna which becomes a complementary magnetic current source with the electric current source on the loop antenna. Then by confronting but not coupling these two complementary antennas and feeding them with phase 90° apart, a desired circular polarized wave radiating characteristic is obtained.

FIG. 4A shows distribution of current i and charges $\sigma$ of a full-wavelength loop antenna whose center is on the z axis on an x-y plane. The maximum current distribution points are on the x axis and the minimum ones on the y axis, the maximum charge distribution points on the y axis and the minimum ones on the x axis, respectively. FIG. 4B shows the resulting electric field E and magnetic field H on the x-y plane.

Figure 5A:
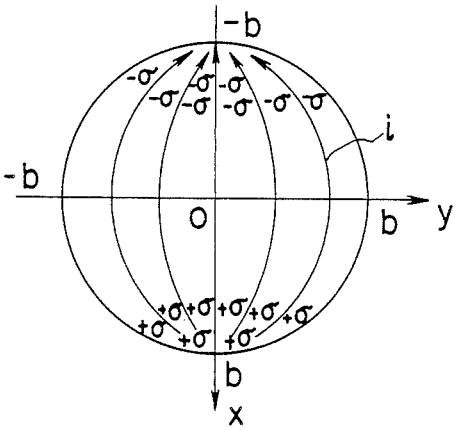
FIG. 5A is a diagram showing current and charge distribution on a full circular patch antenna.
Figure 5B:
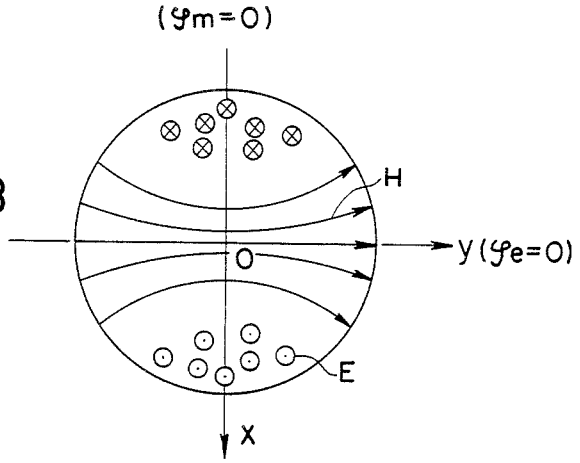
FIG. 5B is a diagram showing a corresponding electric field and magnetic field of the loop of FIG. 5A.

FIG. 5A shows corresponding distribution of current i and charge $\sigma$ on an $E_{110}$-mode full circular complementary patch antenna. The currents i are maximum on the y axis, and charges c are maximum on the x axis. FIG. 5B shows distribution of the corresponding electric field E and magnetic field H on the x-y plane. As is apparent, electric potential $\phi_e$ is zero ($\phi_e=0$) on the y-z plane and magnetic potential is zero on the x-z plane.

As is apparent from a comparison of FIGS. 4B and 5B, the full-wavelength loop antenna and the full circular $E_{110}$-mode patch antenna exhibit complementary characteristics in which electric fields E and magnetic fields H are exchanged with each other, and this means that they are in a complementary relationship.

Figure 6:
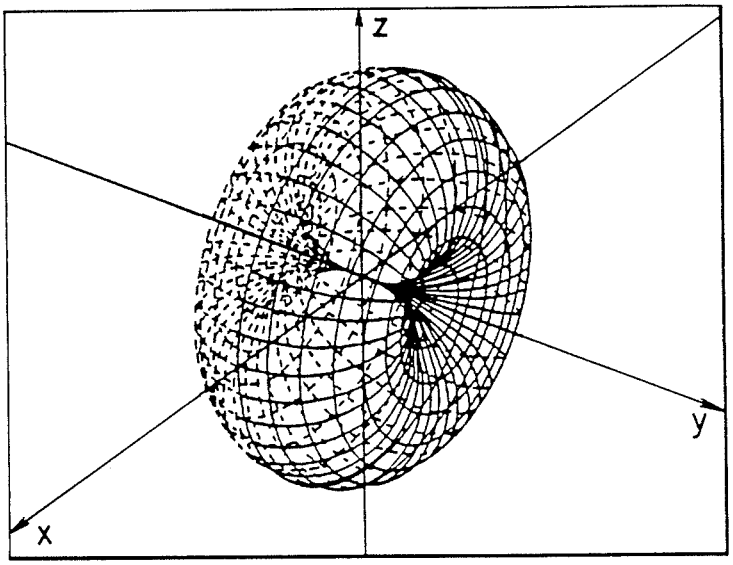
FIG. 6 is a directivity characteristic diagram of a half-wavelength dipole antenna.
Figure 7:
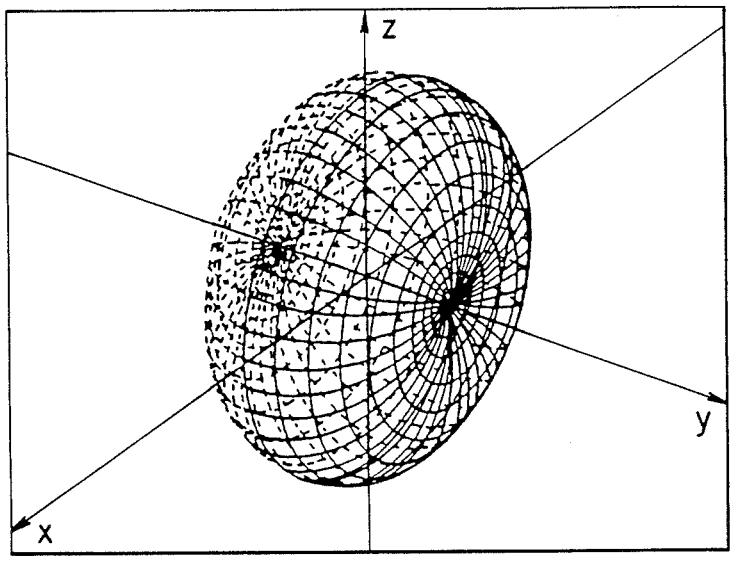
FIG. 7 is a directivity characteristic diagram of a semicircular half-wavelength dipole antenna.

FIG. 6 shows that the radiation characteristic of a classical half-wavelength dipole antenna aligned to the y-axis has null points in the y-axis direction. However, when the half-wavelength dipole antenna has a semicircular configuration as described above and shown in FIG. 1, the radiation in the y-axis direction increases as shown in FIG. 7 and the null points are removed. In this case, the level difference between the maximum radiation direction, i.e. z-axis direction, and the minimum radiation direction, i.e. y-axis direction, is about 8 dB, which means that the characteristic of FIG. 7 does not yet achieve the isotropic characteristic. However, it may practically be regarded as a substantially isotropic characteristic because in a GPS satellite communication, etc. reception is effected in the upper half region expressed by $z>0$. Reception from the direction of the horizontal plane (x-y plane, $z=0$) is actually rare, and reception is normally effected in elevated angles above a certain value.

That is, the two semicircular antennas discussed above, the half-wavelength electric current source antenna and the half circular patch antenna (equivalent to a magnetic current source antenna), have substantially isotropic radiation characteristics, and can be realized by a transformal version of the full-wavelength loop antenna and full circular $E_{110}$-mode patch antenna.

Referring to the full-wavelength loop antenna of FIG. 4A, considering that the current is always zero at the $(0,\pm a,0)$ positions on the y axis, no change occurs in electric current and charge distribution on a half loop existing in $x\geqq 0$ when the antenna loop is cut at said positions and the other half loop expressed by $x<0$ is removed. Therefore, by removing a half of the loop, we arrive at the semicircular half-wavelength electric current source dipole antenna of FIG. 1.

In this case, the loop radius a is expressed by:

$$a = \frac{\lambda_o}{2\pi} \tag{1}$$

where $\lambda o$ is the wavelength in a vacuum.

Figure 8A:
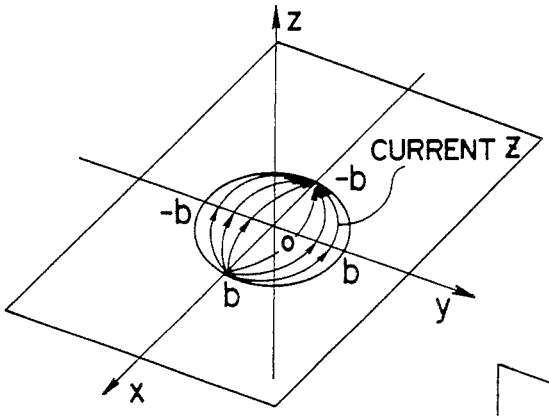
FIGS. 8A–8D present views which show how a semicircular patch antenna is composed.
Figure 8B:
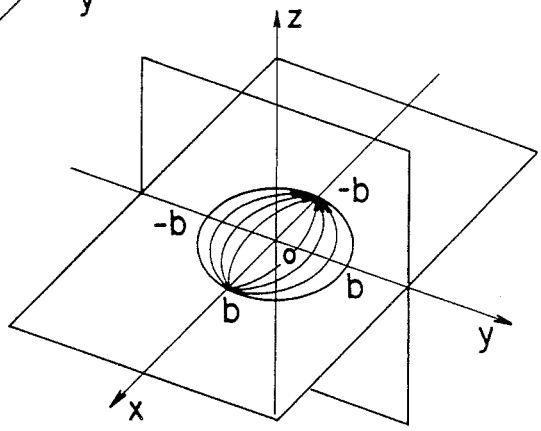
Figure 8C:
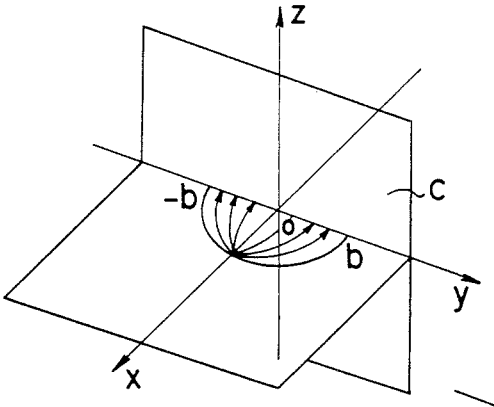

An $E_{110}$-mode patch antenna is discussed below. As is apparent from FIG. 8A, since the electric potential $\phi_e$ is zero ($\phi_e=0$) on the y-z plane, the electric and magnetic characteristics of a full space of this configuration do not change though a perfect conducting plane is put on the y-z plane as shown in FIG. 8B. Accordingly, when putting an infinitely extending full conductor C on the y-z plane and omitting the antenna assembly in the $x<0$ region as shown in FIG. 8C, the electric characteristic of the region of $x>0$ does not change.

Figure 8D:
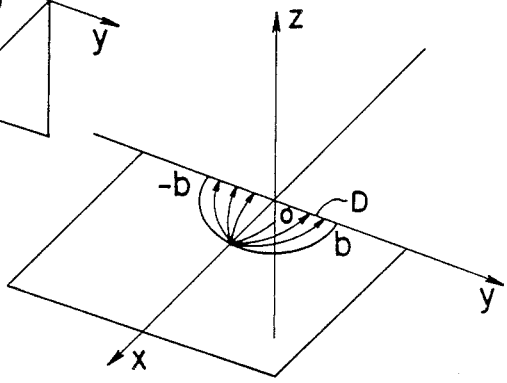

By decreasing the full conductor C on the y-z plane into a dimension still large enough to short-circuit the end surface D of the patch antenna where the electric potential $\phi_e$ is zero ($\phi_e=0$), the antenna comes to behave as shown in FIG. 8D as a semicircular magnetic source antenna, radiation also occurs in the $x<0$ region, and the radiation characteristic of the region approaches the characteristic of FIG. 7. Thus, the patch antenna of FIG. 2A is obtained.

Since the patch antenna is of the $E_{110}$-mode, the radius b thereof is indicated by:

$$b = \frac{\lambda_o}{2\pi} \frac{1.841}{\sqrt{\epsilon_r}} \tag{2}$$

where $\lambda o$ is the wavelength in a vacuum, and $\epsilon_r$ is the dielectric constant of dielectric member 2c. Formula 2 is somewhat different from Formula 1 of the above-indicated half-wavelength dipole antenna. However, as long as their radii are not extremely different, an acceptable complementary relationship between both antennas can be maintained.

Figure 9:
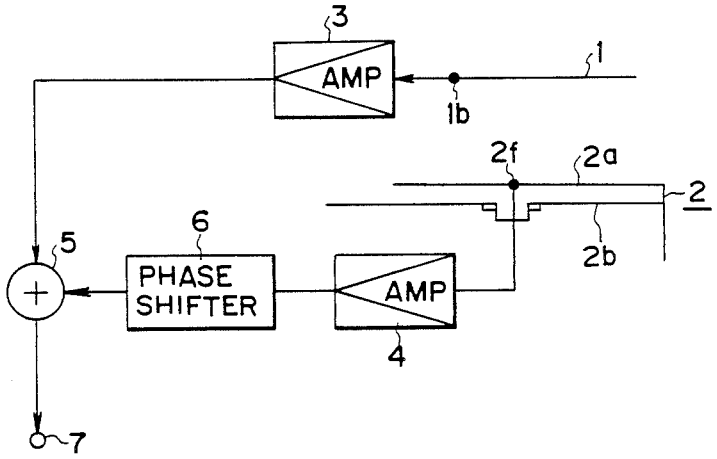
FIG. 9 shows a further embodiment of the invention.

FIG. 9 shows an active reception antenna taken as a further embodiment of the invention.

Antennas 1 and 2 are individually directly connected to amplifiers 3 and 4. An output of the amplifier 3 is connected to one input of an adder 5, and an output of the amplifier 4 is connected to the other input of adder 5 through a phase shifter 6, so that a circularly polarized wave can be received and obtained from an output terminal 7 of the adder 5.

The antennas 1 and 2 form a complementary pair having a quasi-isotropic characteristic as described above. Therefore, by connecting them directly to the amplifiers 3 and 4 in a significant power mismatching condition near a noise matching condition which allows to minimize the coupling of both antennas, and adding respective outputs in 90° phase difference, an active antenna array capable of receiving circular polarized waves is obtained.

As explained above, the invention provides a complementary antenna having a quasi-isotropic, circular polarization characteristic which can be small-scaled, readily handled and inexpensive.

What is claimed is:

1. An antenna comprising:

a half-wavelength dipole antenna in the form of a semicircular ring at a specified frequency;

an $E_{110}$-mode patch antenna having a semicircular substantially planar configuration at said frequency;

means for coupling received power from said dipole antenna and said patch antenna in 90° phase difference to produce circular polarization reception characteristics; and said dipole antenna and said patch antenna being adjacently disposed so the distance between them is relatively short compared to a wavelength at said frequency so as to minimize deviation of circular polarization characteristics.

2. The antenna of claim 1 wherein the semicircular ring lies substantially on a half of the x-y plane ($x>0$) and the semicircular substantially planar configuration of the patch antenna lies substantially on a plane parallel to the x-y plane within a small distance from the x-y plane compared to a wavelength at said specified frequency;

whereby the antenna system is substantially planar.

3. An antenna comprising:

a half-wavelength dipole antenna in the form of a semicircular ring at a specified frequency;

an $E_{110}$-mode patch antenna having a semicircular configuration at said frequency;

a first amplifier connected to receive input from said dipole antenna;

a second amplifier connected to receive input from said patch antenna; and means for adding outputs of said first and second amplifiers in 90° phase difference;

said dipole antenna and said patch antenna being adjacently disposed so the distance between them is relatively short compared to a wavelength at said frequency so as to minimize deviation of circular polarization characteristics, and said amplifiers and said antennas being connected in a substantial power mismatching condition and in a noise matching condition.

4. An antenna according to claim 1 or claim 2 wherein said patch antenna includes a grounding member and a second semicircular antenna element provided on and insulated from said grounding member, said second antenna element being opened from said grounding member at the circumferential portion there and short-circuited to said grounding member at the straight portion thereof.

* * * * *